US008549799B2

(12) United States Patent
Tate

(10) Patent No.: US 8,549,799 B2
(45) Date of Patent: Oct. 8, 2013

(54) POST INSTALLATION

(75) Inventor: Rodney James Tate, Cotton Tree (AU)

(73) Assignee: Feral Pty. Ltd., Maroochydore, Queensland (AU)

( * ) Notice: Subject to any disclaimer, the term of this patent is extended or adjusted under 35 U.S.C. 154(b) by 0 days.

(21) Appl. No.: 13/319,421

(22) PCT Filed: May 7, 2010

(86) PCT No.: PCT/AU2010/000533

§ 371 (c)(1),
(2), (4) Date: Jan. 16, 2012

(87) PCT Pub. No.: WO2010/127407

PCT Pub. Date: Nov. 11, 2010

(65) Prior Publication Data

US 2012/0110930 A1 May 10, 2012

(30) Foreign Application Priority Data

May 8, 2009 (AU) ..... 2009902025

(51) Int. Cl.
*E02D 5/74* (2006.01)
*E04B 1/00* (2006.01)

(52) U.S. Cl.
USPC ..... 52/157; 52/156; 52/166; 52/745.21

(58) Field of Classification Search
USPC ..... 52/156, 157, 165, 166, 745.21, 741.11; 248/530, 545, 156; 135/16, 66
See application file for complete search history.

(56) References Cited

U.S. PATENT DOCUMENTS

| | | | | | |
|---|---|---|---|---|---|
| 930,607 | A * | 8/1909 | Morrill | 52/165 |
| 3,011,598 | A * | 12/1961 | Galloway et al. | 52/153 |
| 4,162,789 | A * | 7/1979 | Hollaway | 473/499 |
| 4,833,846 | A * | 5/1989 | McFeetors et al. | 52/154 |
| 5,358,209 | A * | 10/1994 | Ward | 248/545 |
| 5,396,916 | A * | 3/1995 | Boissonnault | 135/16 |
| 5,613,329 | A * | 3/1997 | Land et al. | 52/157 |
| 6,547,203 | B1 * | 4/2003 | Willard | 248/530 |
| 6,682,267 | B1 * | 1/2004 | Jones | 405/252.1 |
| 7,497,053 | B2 * | 3/2009 | Nicolet | 52/161 |
| 7,942,377 | B2 * | 5/2011 | Harold et al. | 248/545 |
| 2012/0110930 | A1 * | 5/2012 | Tate | 52/157 |

FOREIGN PATENT DOCUMENTS

| | | | |
|---|---|---|---|
| JP | 2001-059221 | A | 3/2001 |
| JP | 2004-84268 | A | 3/2004 |
| JP | 2004-159469 | A | 6/2004 |

* cited by examiner

*Primary Examiner* — Andrew Triggs

(74) *Attorney, Agent, or Firm* — Renner Kenner Greive Bobak Taylor & Weber

(57) ABSTRACT

A method of securing an elongate member in the ground which includes the steps of embedding the member within a matching size and shaped hole in the ground then ensnaring the member with a ground anchor that passes substantially through the member intersecting the member. The invention also applies to a member with a ground anchor positioned therein and also having a lightening nut.

8 Claims, 16 Drawing Sheets

POST INSTALLATION

This invention relates to a post installation, an installation in the ground providing for support for a post, a method of installing and effecting support within the ground for a post, and a member or members facilitating such installations.

BACKGROUND OF THE INVENTION

The problem to which this invention is directed relates to conventional methods of installing posts in the ground.

It is known to drill a cylindrically shaped hole in the earth and then insert a post with either a smaller diameter or otherwise alternate cross-sectional shape which will readily fit within the hole then either tamp the earth surrounding the post or fill an area between the post and the wall hole to effect a locking of the post in the ground.

It is known to use ground anchors which conventionally include a shaft, and a helical shape at an outer end and an interlocking shape at the opposite end which is then caused to be rotated about its longitudinal axis and effect a screwing of the ground anchor into the ground. The mere use of a ground anchor has not been found hitherto to be especially useful in connection with fence posts where a high degree of lateral stability might be needed.

BRIEF DESCRIPTION OF THE INVENTION

My proposal is to have an arrangement in which a post or a stub is imbedded within the ground and then a ground anchor or anchors is or are used where they are caused to capture a lower end of the post or stub beneath the surface of the earth.

In other words, we propose that there can be provided lateral stability by having a post embedded in the ground or a stub into which a post can be located, but then drive one or more ground anchors through the post or stub so that they will extend further below the hole in which the post or stub is preliminarily positioned, and have an impinging shape with a portion of the stub or lower portion of the post so as to hold this post or stub then more positively in position.

In another form of the invention it could be said to reside in a method of securing an elongate member in the ground, including the steps of boring a hole of a selected diameter and to a selected depth in the earth, inserting the elongate member into the hole which has at least a lower most ground engaging portion with outer dimensions and shape that will nest with a closely matching diameter within the hole, the member having a passageway passing fully therethrough from end to end and having an intersection aperture of shape and size to effect an intersection of a higher portion of a ground anchor, effecting an anchoring of the member by the ground anchor which has a lower most ground engaging portion arranged to enter and be anchored in the ground by rotation thereof and an upper portion being engageable by rotational driver means to effect a rotation of the ground anchor about its elongate axis, then effecting such rotation to an extent that the ground anchor intersects with earth beneath the hole and effects a holding of the member in the ground thereby upon intersection of the intersection portion of the ground anchor with an intersecting part defining the intersection aperture, the ground anchor having a portion of its body having a thread there around, and a nut threadably engaging the thread the method including the further step when the ground anchor is in a ground anchoring position and intersecting the intersecting shape of the member, of tightening the nut with respect to the intersecting shape to effect a further pull down of the member.

In an alternate form, there is further inserted a post into the thus anchored member.

In a further alternate form, there are at least two ground anchors each ground anchor aligned to pass through for each, a different opening at or toward the lower end of the member.

In a further form the invention could be said to reside in an elongate member having a lower end shaped and of a size to be located and to be held within a hole in the ground, a passageway through the member, a ground anchor having a lower end with a ground engagable shape adapted to be screwed into the ground, an intersecting shape within the member with a portion of the ground anchor being above such intersecting shape and a lower end of the ground anchor being below the intersecting shape, a top of the ground anchor shaped to receive and interlock with a rotatable driver, the upper portion of the ground anchor having a thread there around, and a nut threadably engaging the thread adapted to intersect with the intersecting shape when the ground anchor has been rotatably driven into the ground.

This invention has particular application to mechanizing installations of posts for instance where a mechanized fencing apparatus is used which can carry with it means to bore a preliminary hole in the ground, insert a post and then rotate a ground anchor by engagement through the post to effect then the embedment of the post within the ground and further anchoring with a ground anchor beneath the ground.

This however is not intended to be the only application but illustrates the particular advantage of the invention.

BRIEF DESCRIPTION OF THE DRAWINGS

For a better understanding of this invention it will now be described with the assistance of drawings which will be described in connection with a preferred embodiment wherein.

DESCRIPTION OF THE EMBODIMENTS

In the embodiment, one particular form of ground anchor is shown but a ground anchor can have different configurations and still provide the function fulfilling this purpose.

A ground anchor has at one end a shape which will effect by rotation a screwing into the earth and a subsequent anchoring once screwed deeply into the earth.

In the instance shown in this embodiment there is a single central axially aligned shaft with at its furthest end a pointed shape but located behind this is a blade formed to effect in helical manner a screw engagement into the earth when rotated generally about the axis of the shaft.

In a further form of ground anchor, this includes a shaft which is bent into a spiral shape at its further end and by this reason effects this ability to be screwed and interlocked within earth and not be able to be easily withdrawn without assisted rotation thereafter.

Figure 1:
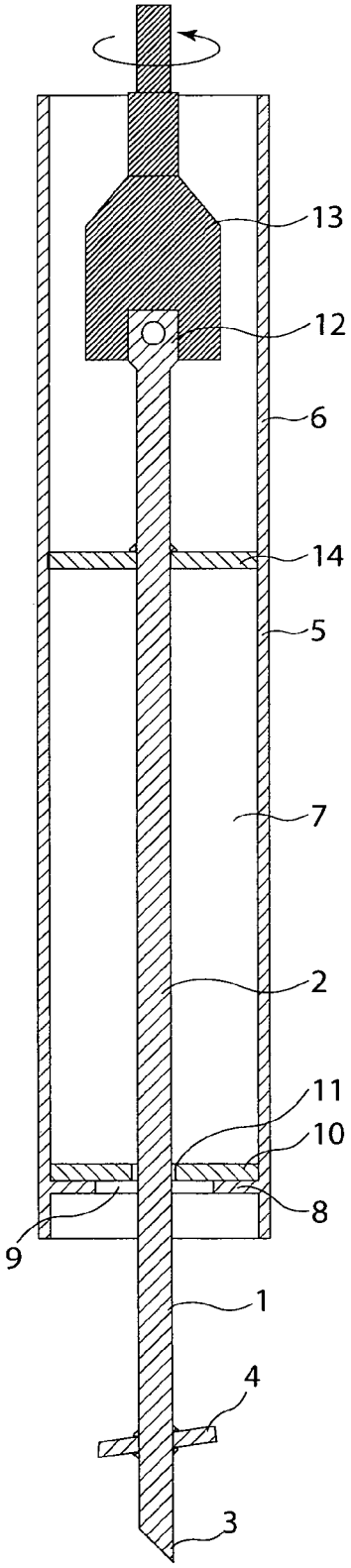
FIG. 1 is a cross-sectional view of an apparatus according to a first embodiment showing a post and a ground anchor in a preliminary position with an overhead boss engaging the top of the ground anchor to effect rotation of this, FIGS. 2*a* through to 2*e* illustrate in steps a first digging of the hole, an insertion of the post with a ground anchor being supported above it, effecting entry of the ground anchor through the post into the ground beneath the post, then inserting a further post within the ground embedded post portion with 2*e* being a final assembly, FIG. 3*a* through to FIG. 3*c* illustrate in greater detail the embedding of a post portion and the winding of a ground anchor through the centre of this to a position beneath the ground.

In the first embodiment as described in FIG. 1 and the sequence of drawings with 2*a* through to 2*d*, there is a ground anchor (1) which has a long and sentially straight shaft (2), a pointed end (3) and a helically shaped configured blade (4) which is secured by welding to the shaft (2).

A post support arrangement generally shown at (5) includes a cylindrical stub portion (6) which provides an outer most cylindrical shape and an inner generally cylindrical passageway (7).

At a lower end of the cylindrical shape there is an inwardly directed flange (8) leaving however an aperture (9) by which the blade (4) can pass through when assembling the apparatus.

A loose disc (10) sits at the bottom of the inner passageway (7) and has a central aperture (11) by which the shaft (2) of the ground anchor can be maintained in relative alignment while it is being screwed into the earth.

An outer end of the ground anchor (1) has an interlocking shape at (12) by which a head (13) from a rotating driver not shown can engage with the interlocking head (12) and cause this to rotate and thence effect a drive of the anchor into the earth.

A collar (14) is secured part way along the length of the shaft (2) so that it will also then maintain vertical alignment as the shaft is rotated into the ground.

Figure 2B:
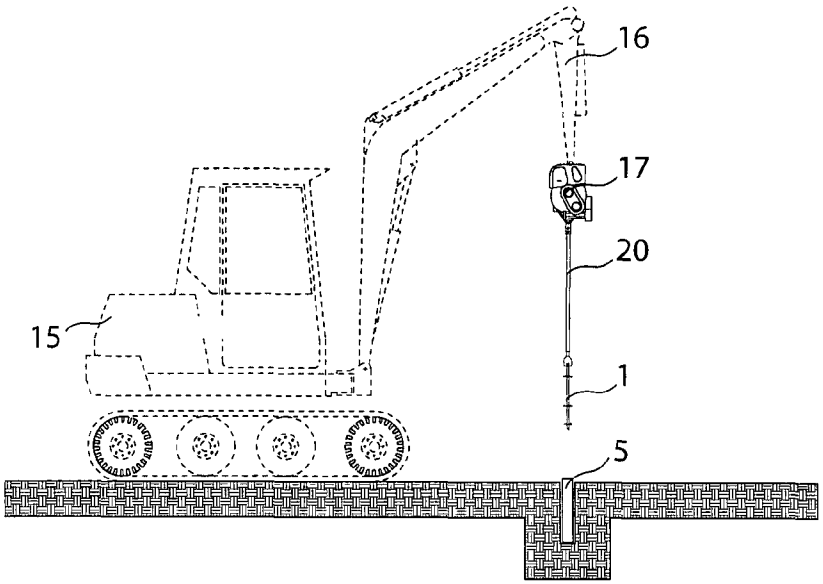
Figure 2A:
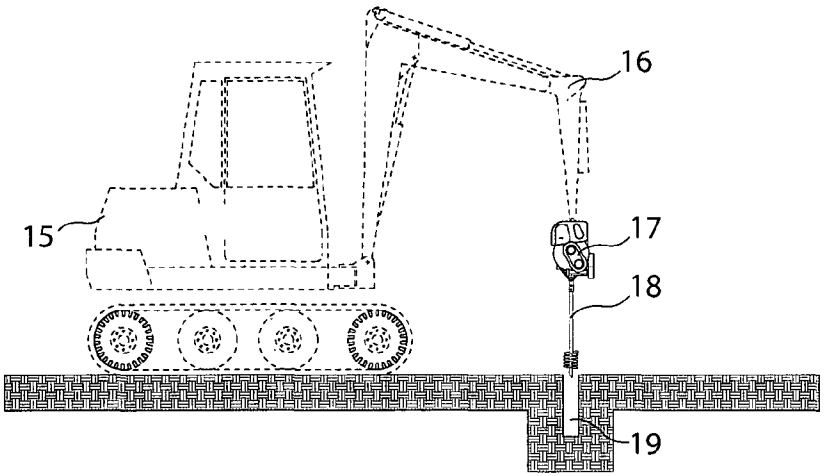
Figure 2D:
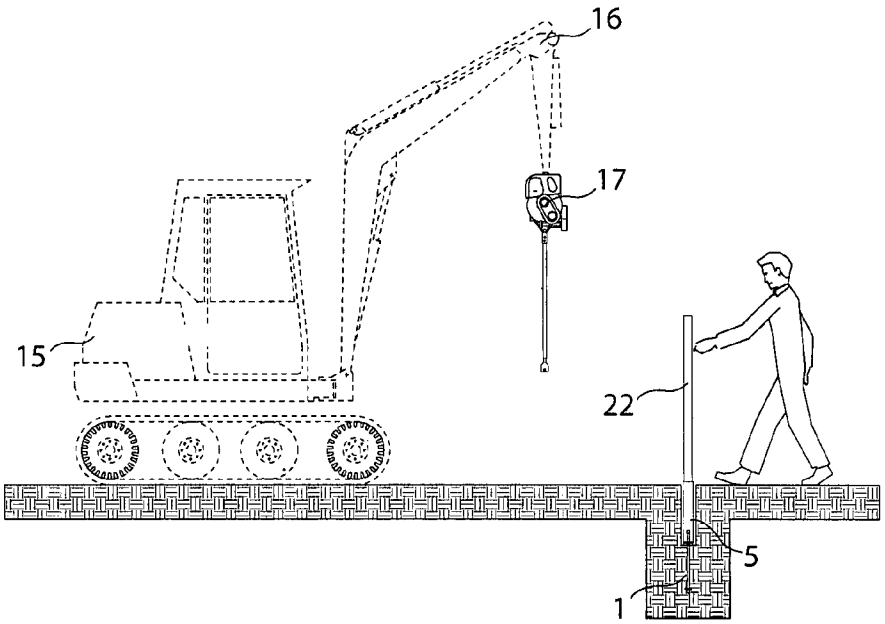

FIGS. 2*a* through 2*d* illustrate the steps by which the system is installed and this shows in representative fashion a vehicle (15) which carries with an overhead arm (16) a rotational driver (17) which in the first instance in FIG. 2*a* supports a post hole digger (18) by which a bore (19) is drilled into the earth a selected distance.

This distance is chosen so as to provide sufficient sideways stability for the post and for the application thereafter and it can vary from relatively deep to relatively shallow depending on the application.

Figure 2C:
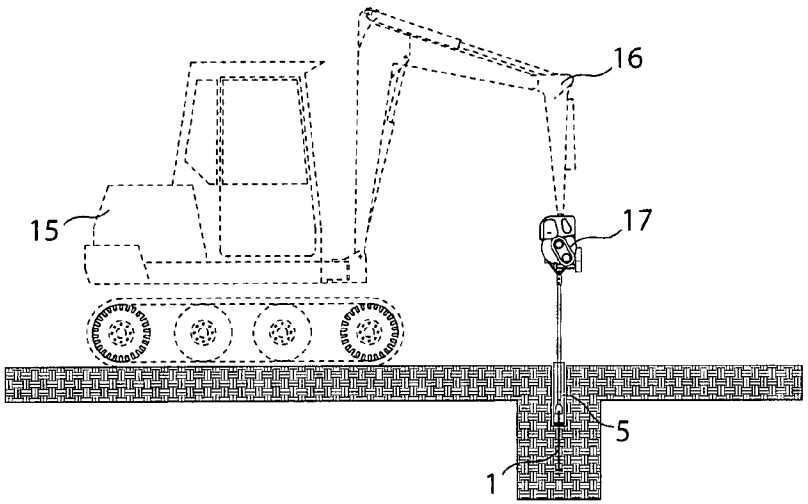
Figure 2E:
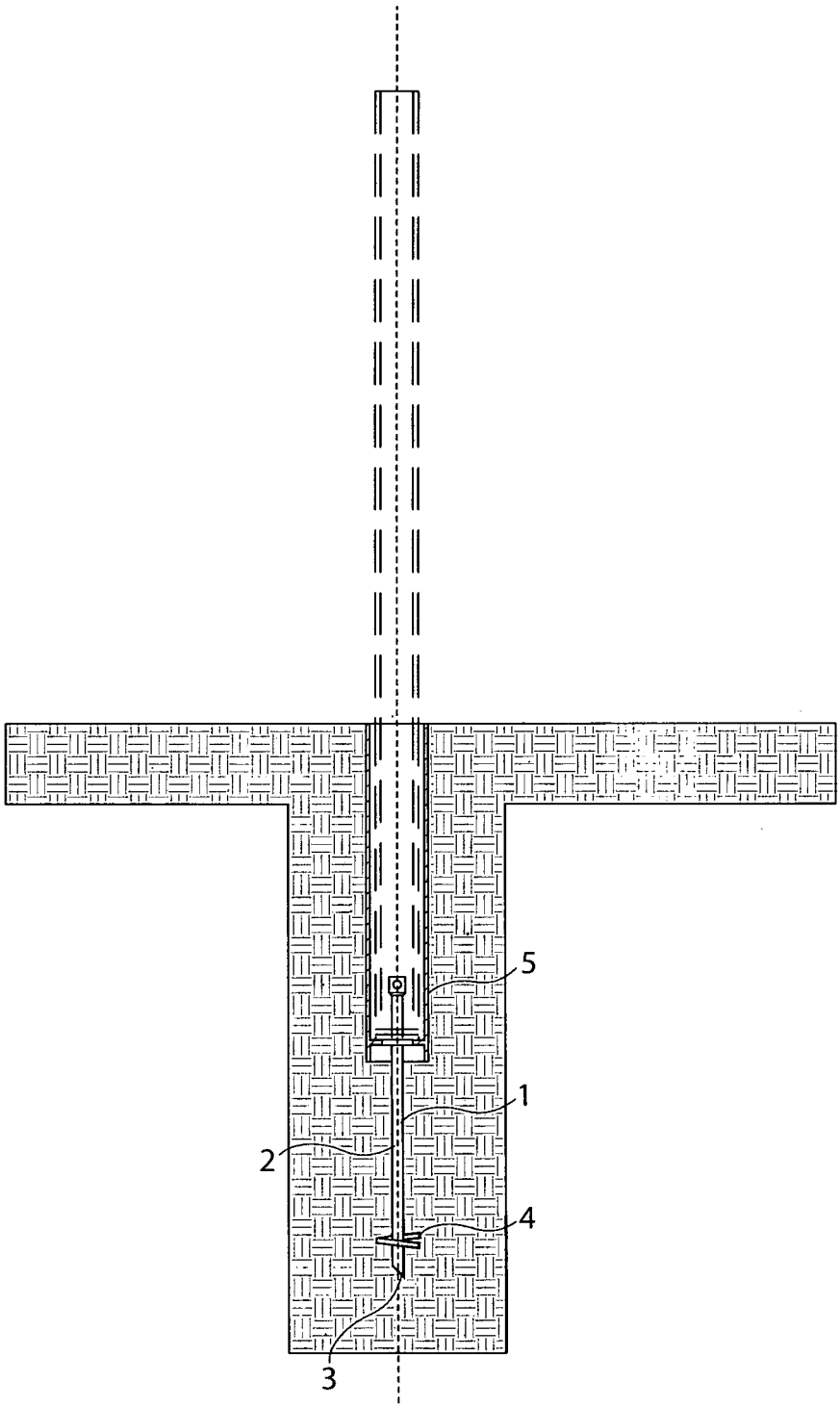

In this case, there is provided a stub cylindrical portion the details of which have been shown in FIG. 1 which has an outer diameter that closely matches the diameter of the hole or bore (19) and once inserted, the ground anchor (1) replaces the post hole borer (18) and there is a rotatable shaft (20) which then effects rotation of the ground anchor (1) which is then lowered into the stub (5) and is continued to be rotated until fully embedded to its hilt as is shown in FIG. 2*c*.

Thereafter, a hollow post (22) is lowered into the stub (5) and is then positioned to perform as a fence post or any other appropriate purpose.

The combination of embedding a stub or a post and securing these with a ground anchor that catches at or toward the lower end of the portion within the bore provides significant advantages from the point of view of stability retention capability.

Figure 3C:
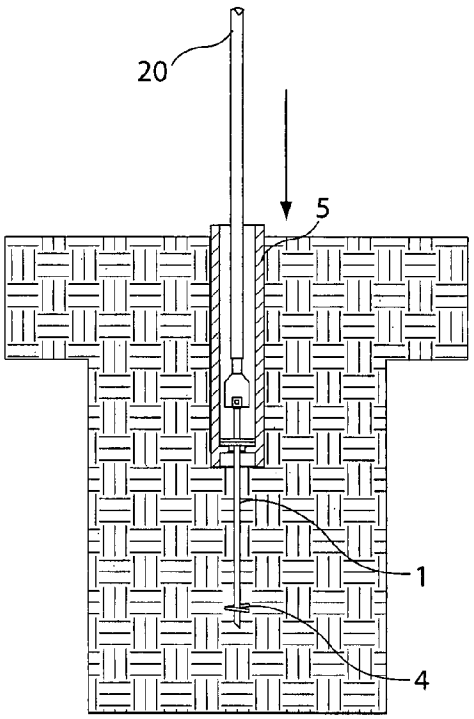
Figure 3B:
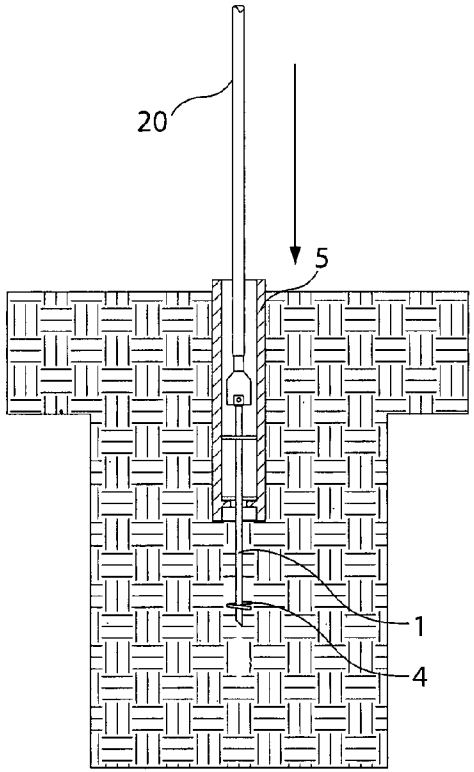
Figure 3A:
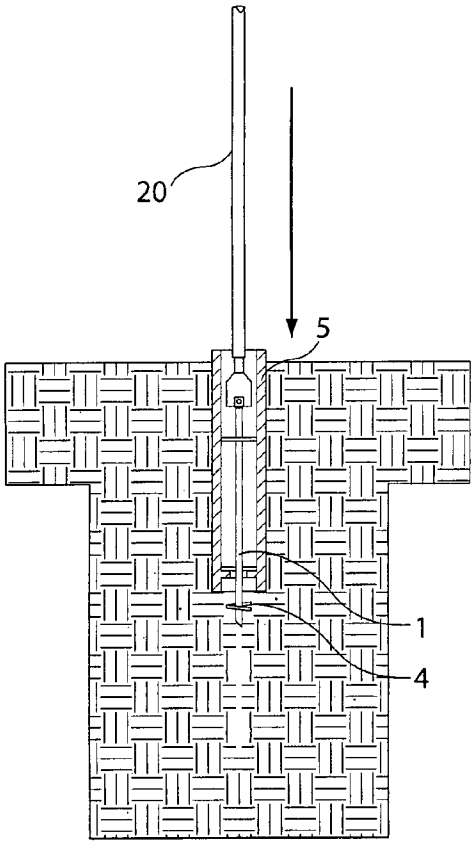
Figure 4A:
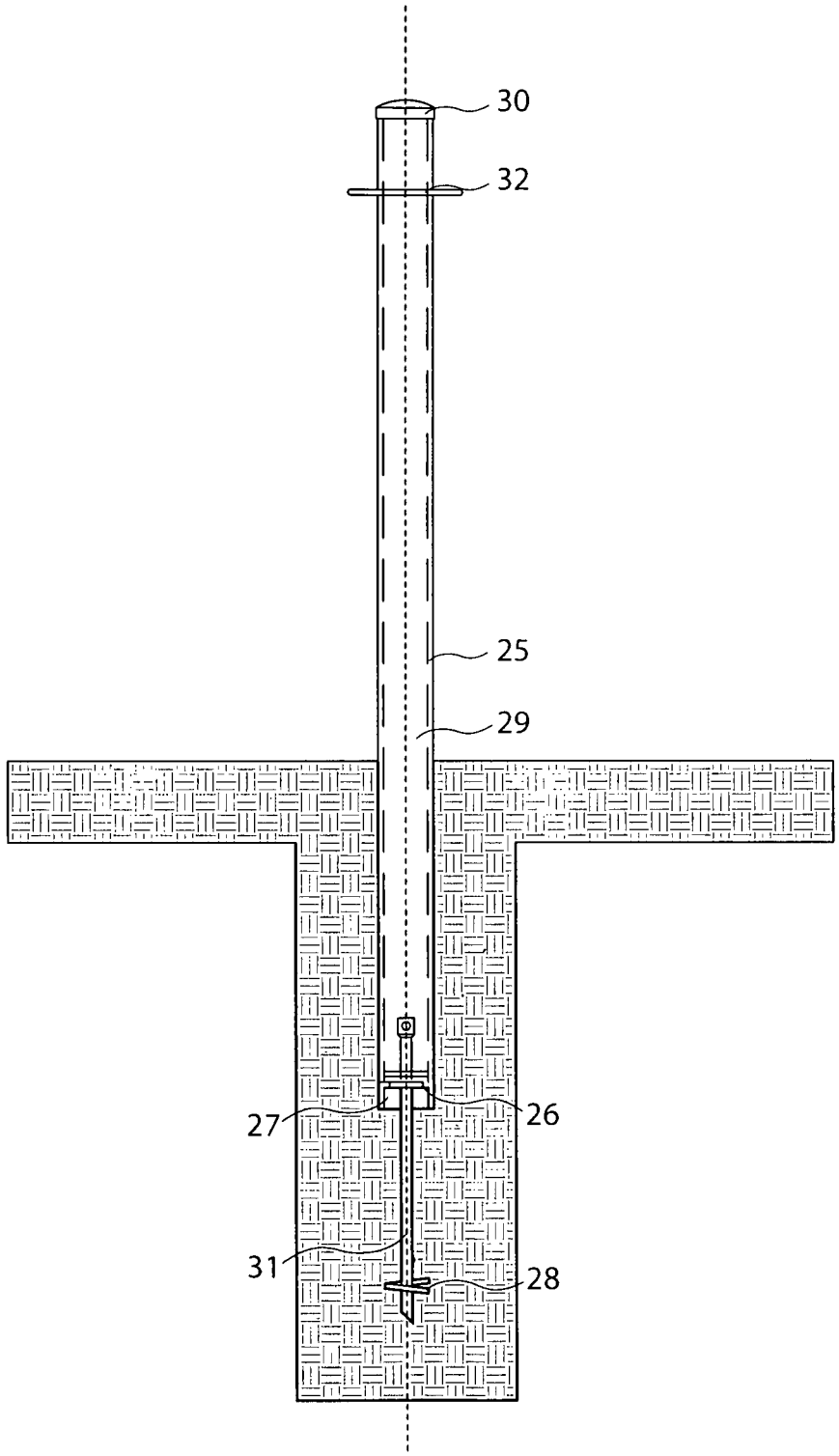
FIG. 4*a* is a schematic view where the post in this case is of full height so that its lower end simply is embedded within the ground and then the ground anchor is caused to pass fully through the post to an embedded position beneath the post.
Figure 4B:
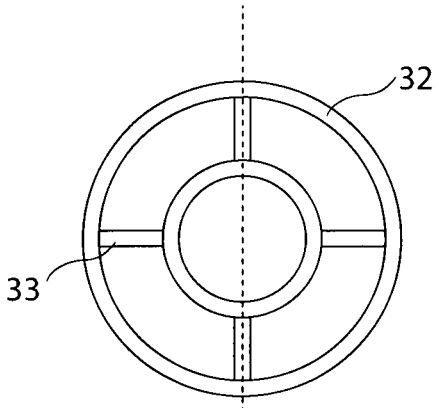
FIGS. 4*b*, 4*c* and 4*d* are respectively a view from above, a side view and a view from below of the post as in FIG. 4*a*.
Figure 4C:
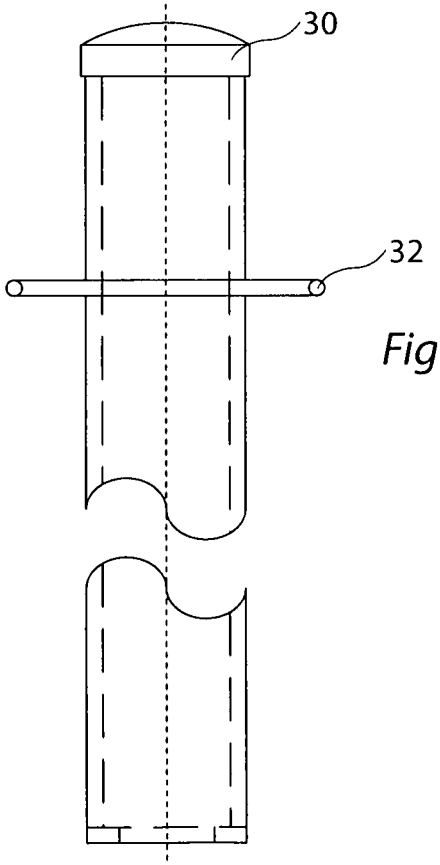
Figure 4D:
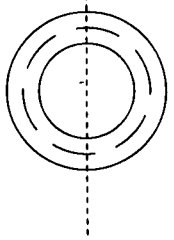

FIGS. 3*a* through 3*c* illustrate in greater detail the screwing of the ground anchor into the ground beneath the stub (5) where the arrangement is again as in FIG. 1 and FIGS. 2*a* through 2*d*.

FIGS. 4*a*, 4*b*, 4*c* and 4*d* illustrate a variation in the way the invention can be carried out in which the post is configures so that it is directly inserted into the ground and anchored thereby.

In particular, the post (25) has across its lower end (26) a flange with a central aperture (27) sufficient to allow the helical shaped blade (28) to pass therethrough.

The post (25) is of cylindrical shape and of constant cross-sectional diameter substantially through its length and provides an inner passageway (29) through which a rotational shaft such as that shown in FIGS. 3*a* through 3*c* at (20) can be used to then pass through the top (30) with the cap shown here removed, and this then allows a ground anchor (31) to be inserted through the top and pass fully through the passageway (29) to be screwed through the bottom of the post (25).

In this case there is a ring (32) which is attached near the top of the post (25) and this is useful to engage strainer stays or compression stays to further bolster the stability of the post when used for instance in a fence strainer post situation.

Figure 5:
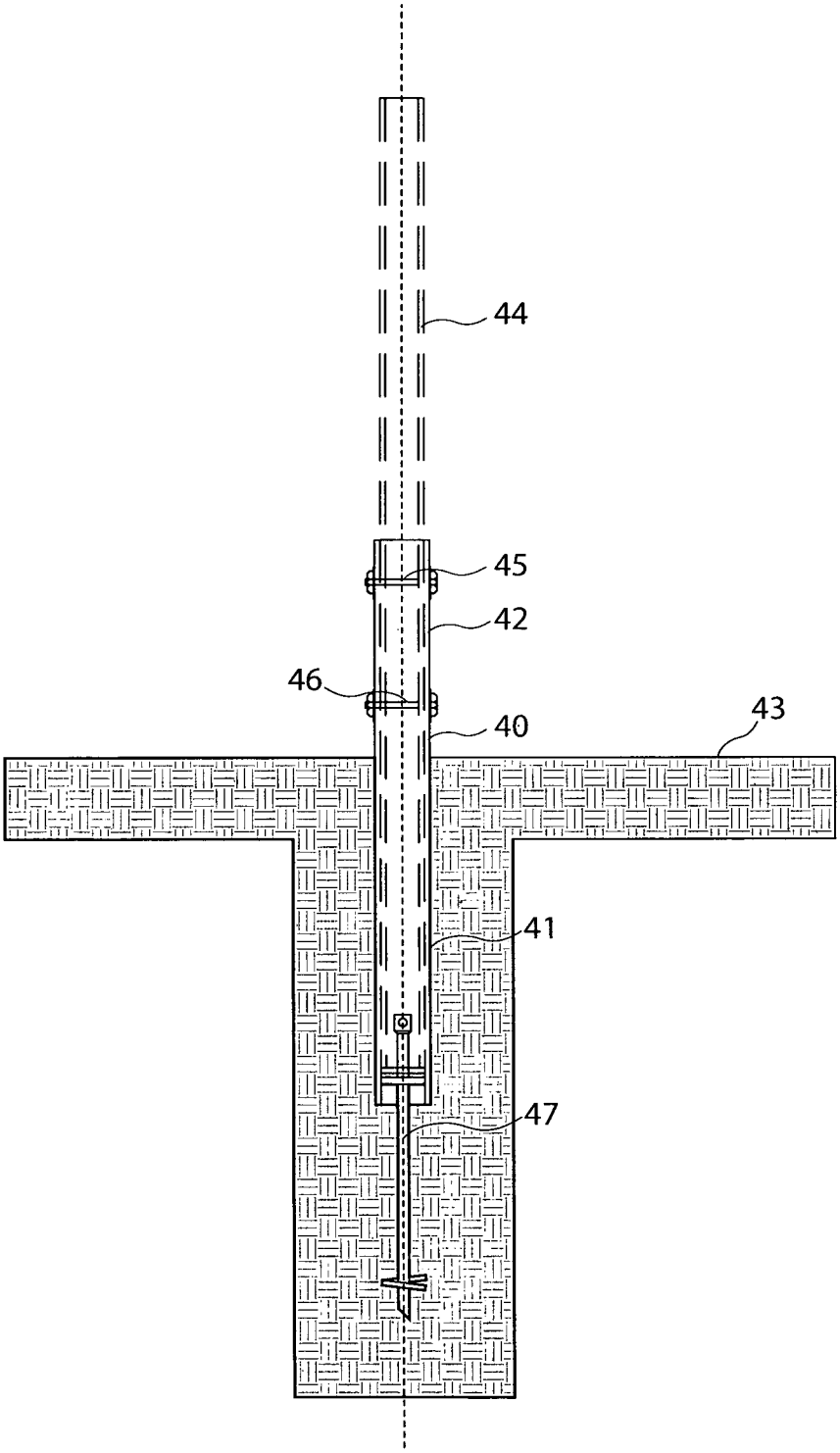
FIG. 5 is a cross-section through the earth showing a cylindrical stub embedded within a bored hole within the ground with an anchoring ground anchor engaging the earth below the bore and a portion extending above the ground to which a post can be secured.
Figure 6A:
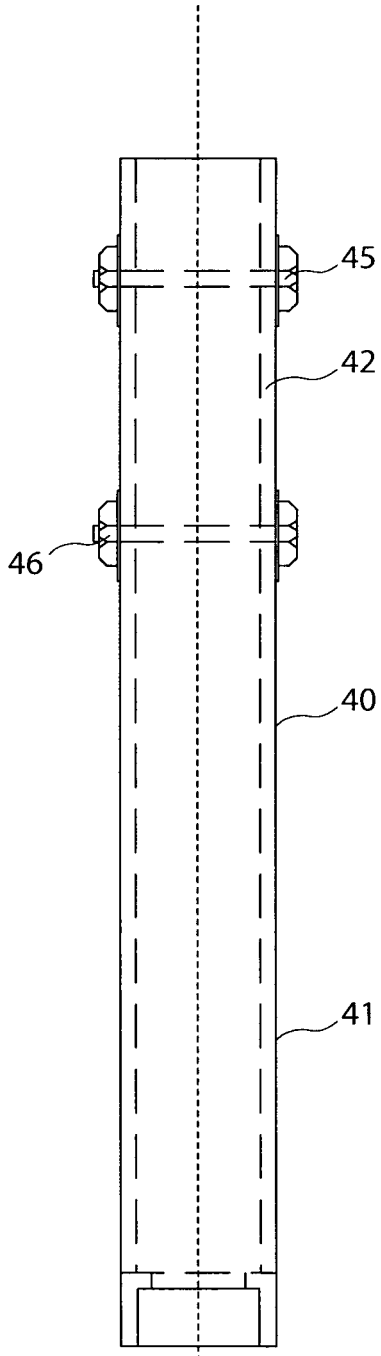
FIGS. 6*a* and 6*b* are further drawings of the stub being a side elevation, and a view from beneath.
Figure 6B:
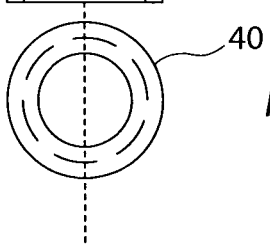
Figure 7A:
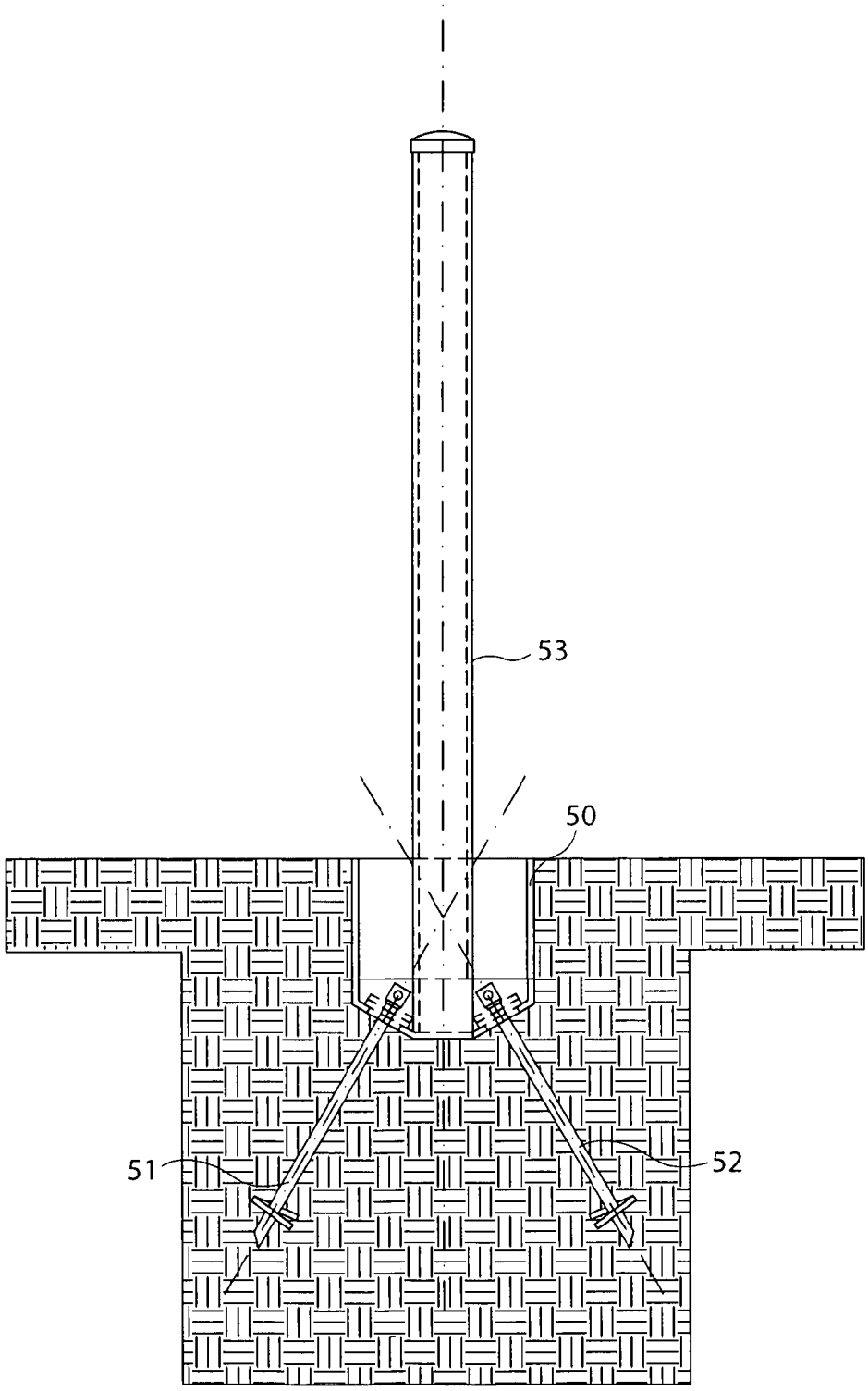
FIG. 7*a* is a cross-sectional view of an embodiment in the earth showing in this case a further stub within a bore within the earth, and multiple ground anchors extending to below the stub and post.
Figure 7B:
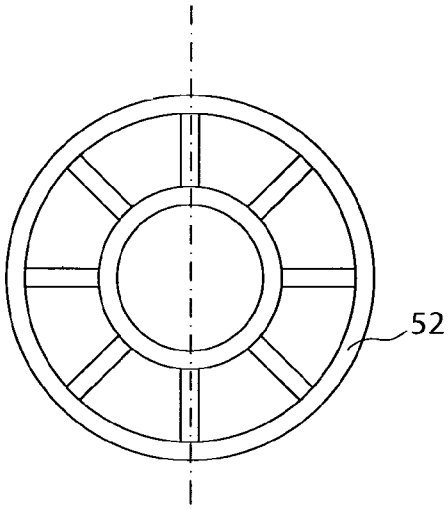
FIGS. 7*b* through *d* show this further stub with a view from above, a cross sectional view and a view from below.
Figure 7C:
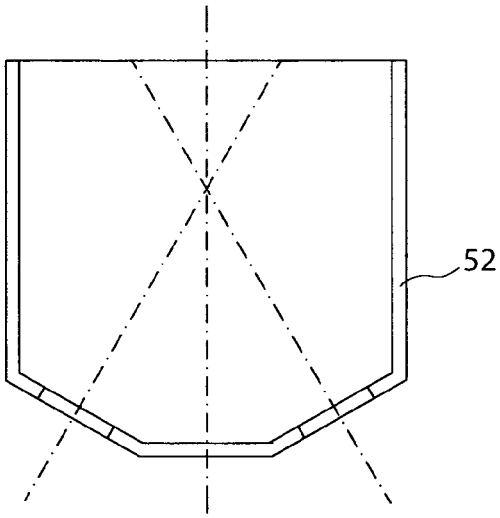
Figure 7D:
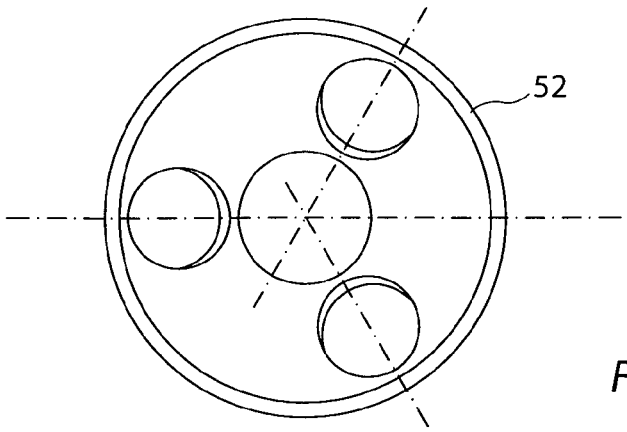
Figure 8:
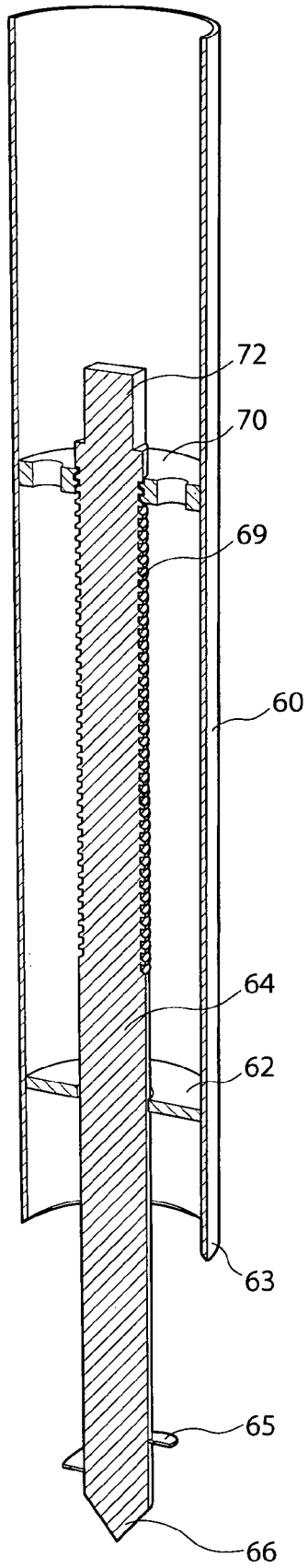
FIG. 8 is a further embodiment this showing a perspective cross-sectional view of an elongate member according to this further embodiment.
Figure 9:
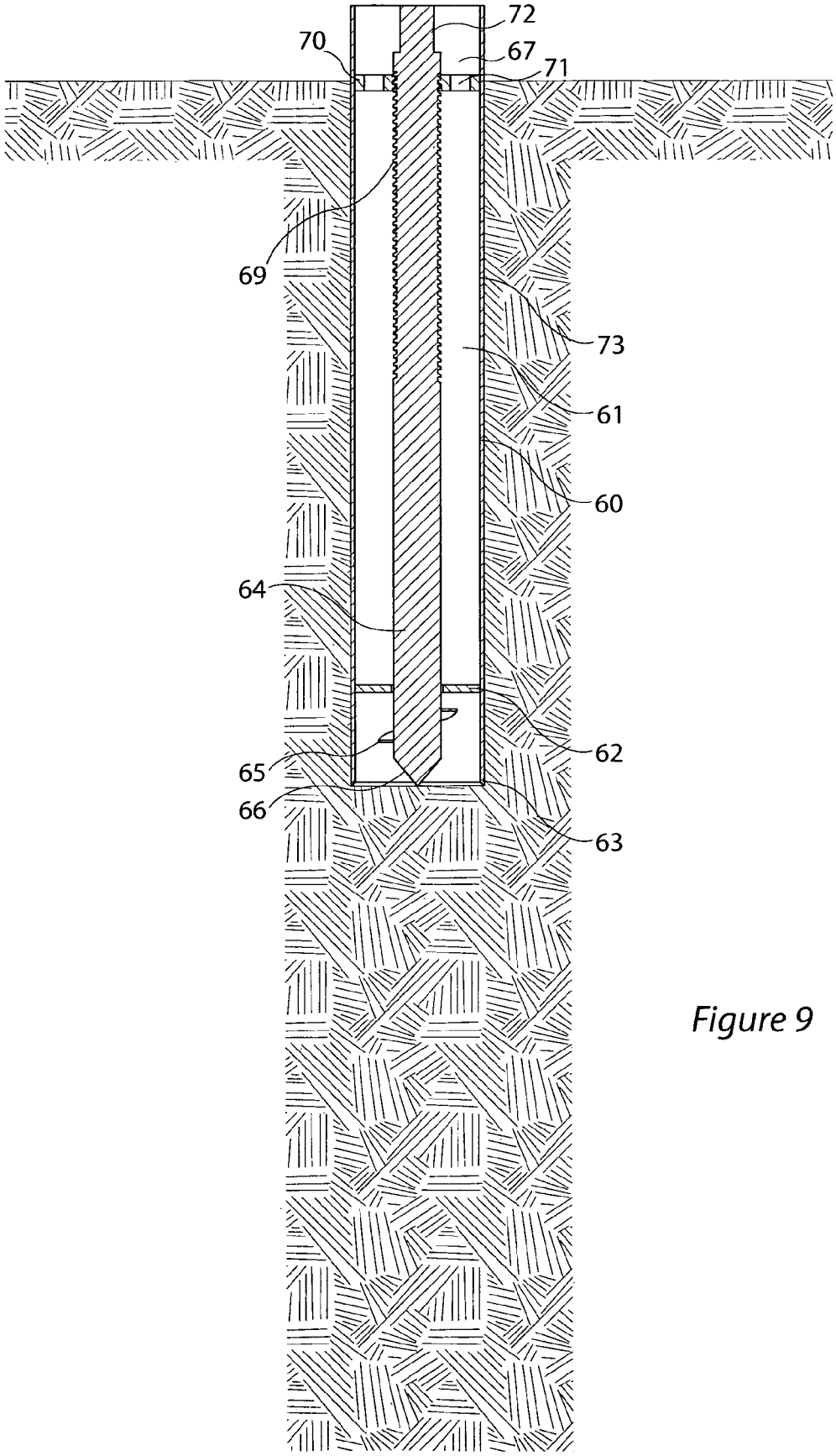
FIG. 9 illustrates the positioning of such further embodiment when embedded within the ground and prior to effecting rotation of the ground anchor.
Figure 10:
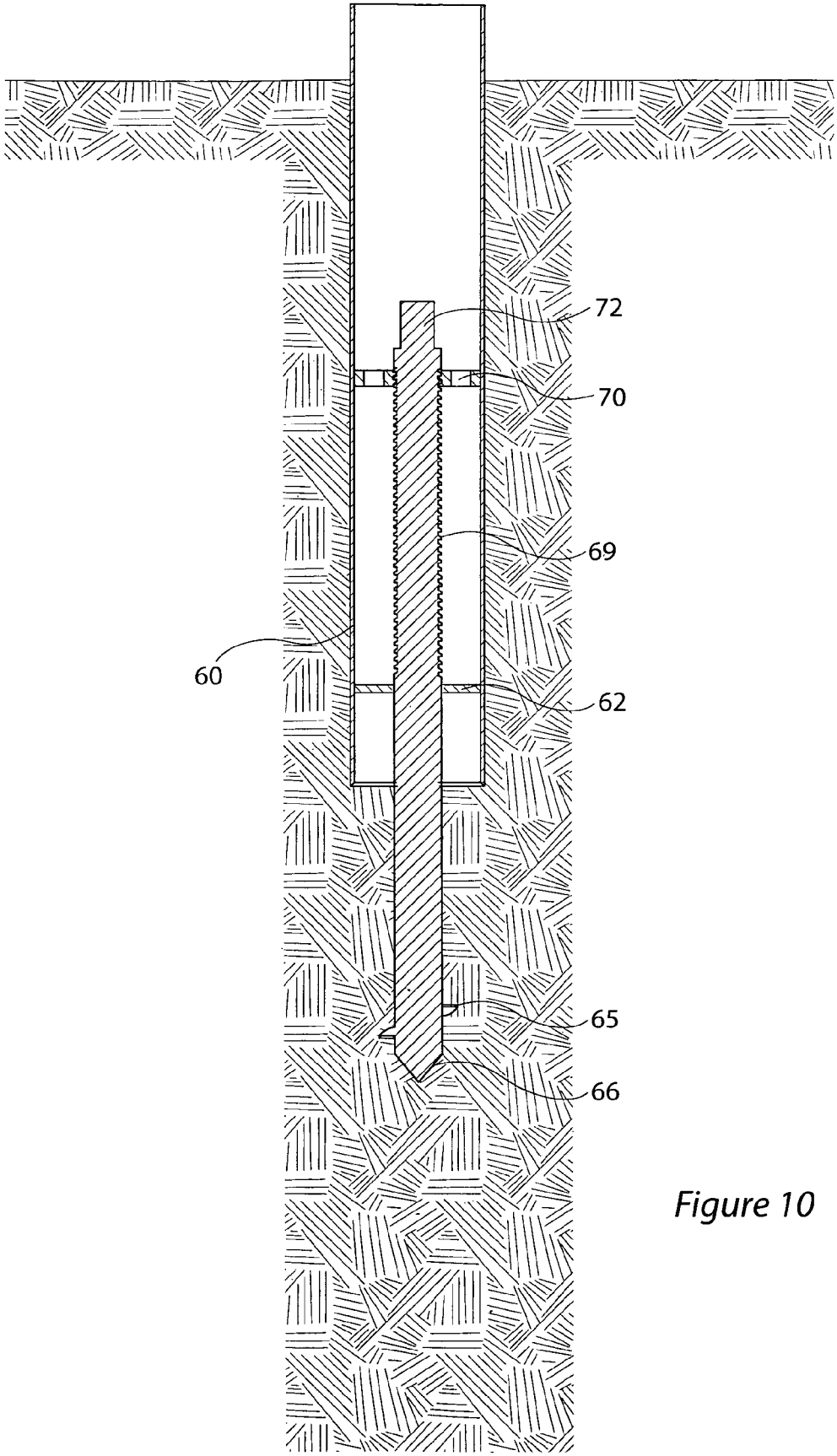
FIG. 10 is the same view as in FIG. 9 with however, the ground anchor in this case now being rotatably driven by means not specifically shown so that it is now partially engaged in the ground
Figure 11:
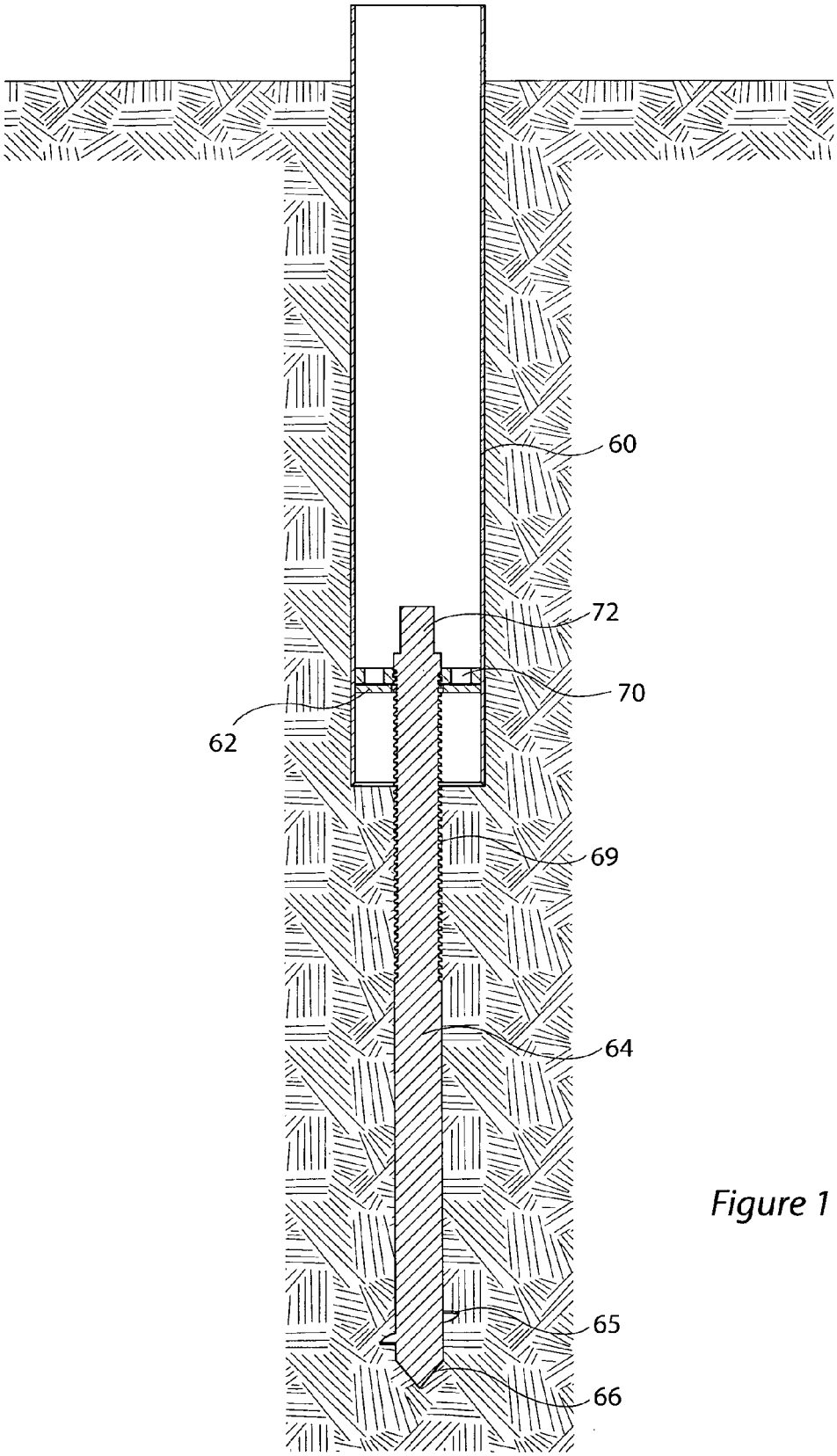
FIG. 11 is a view as in FIGS. 9 and 10 where the ground anchor now is fully engaged within the ground and is holding the body in a tightly nesting bore.
Figure 12:
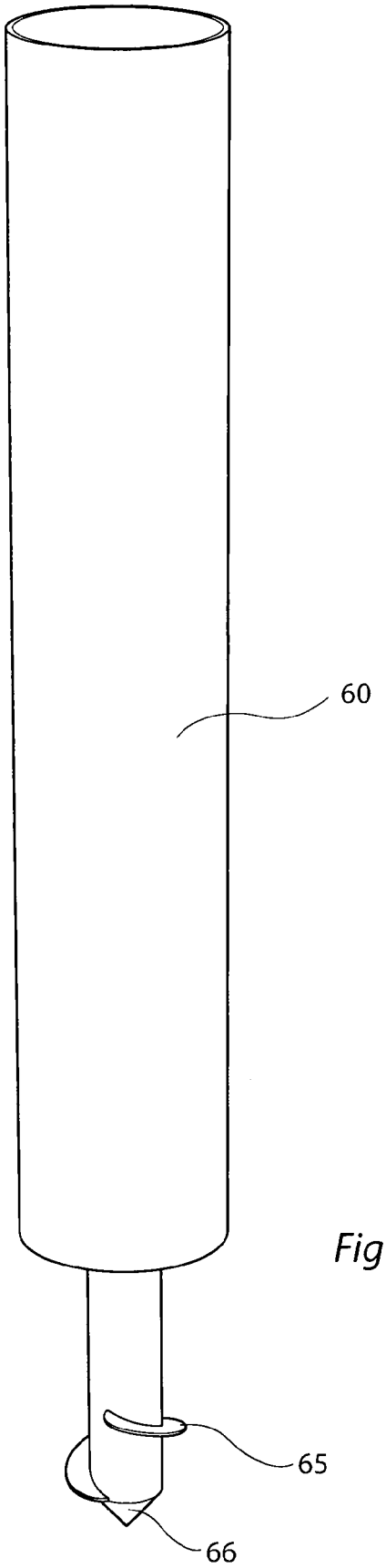
FIG. 12 is a perspective view of the outside of the further embodiment.

While we have described both a stub arrangement which is located within the bore within the earth and has an upper end which is generally coincident with the level of the earth, and we have in another case, a post which is fully hollow which therefore does not need a stub locator, there might be occasions when an upper post might not have a hollow passageway therethrough and in such a case, there is a further embodiment where the stub portion extends modestly above an earth level so that as shown in FIGS. 5 and 6*a* and 6*b* the stub portion (40) has an earth entrained portion (41) and a portion (42) which protrudes above an earth level (43).

The portion (42) above the earth level (43) is adapted to receive a post (44) and in this embodiment two bolts (45) and (46) which mutually pass through the walls of the post (44) and the stub portion (40).

Otherwise there is a ground anchor (47) impinging the stub portion (40) significantly below the ground level (43).

Further details of this extended stub portion are shown in FIGS. 6*a* and 6*b*.

In a further embodiment, there is a stub portion (50) shown in FIGS. 7*a* through 7*d* which is adapted to receive and be held by more than one ground anchor as is shown at (51) and (52) and there is in this case a further ground anchor not shown.

Stabilizing fins are not shown in several of the drawings but are used so that a post (53) can now again be anchored within the hollow of the stub portion (50) and be held stable thereby.

The further embodiment now shown in FIGS. 8 through 12 include a cylindrically shaped outer body (60), a passageway passing fully through the body at (61) and there being an intersecting shape (62) close to but not at the bottom (63) of the member (60). This allows the thin lower outer edge of the cylindrical body to cut a little into the earth beneath the hole.

A ground anchor (64) has at its lower end a cutting head (65) which is adapted together with the pointed end (66) to effect entry by being pushed into the soil and rotated thereafter to an extent that an upper end of the ground anchor (67) will be pulled to intersect with the intersecting shape which in this case is a co annular sheet of material at (62).

The body of the ground anchor (64) has around its upper end at (69) a thread and there is a nut (70) which has apertures (71) which are adapted to be engaged by fingers of a rotating drive device which is not shown to effect when the top of the ground anchor at (67) is intersecting with the intersecting shape (62).

(72) of the ground anchor is square in cross-section and of consistent shape and size along its length so that it can be engaged by an appropriately shaped cowl of again a rotatable driving head to effect drive of the ground anchor.

It is implicit in this case that the hole in which the body (60) is located is closely matching the outer shape of the cylindrical shape (60) so that this hole (73) will hold against lateral movement and distortions thereafter especially once the ground anchor has been fully rotated home.

However, it is an issue that the nut (70) will be kept at an upper end of the screw thread (69) while the ground anchor is driven into the earth and until the nut (70) intersects with the intersecting member (62).

Then, there is effected a further rotation of the nut relative to the shaft (64) which then effectively tightens the body by pulling it down into the earth using the ground anchor on which to pull and this then effects a significant tightening of the member within the earth.

This assemblage therefore provides for a convenient assembly to be used for a number of different applications where for instance posts are to be secured in the ground, the ends of conduits can be anchored for instance as in a tent structure and the anchors can themselves together with the hole, be aligned to be offset to the vertical for appropriate applications.

As will now be seen, by combining a bore within the earth, a hollow member having an impinging shape so that a ground anchor can then be used in conjunction with this pin such member substantially below the level of the earth, this then provides for additional stability and can be effected in an economic way.

It is estimated that such a method and arrangement will significantly improve the efficiency for installing posts especially where these will be required in multiple instances such as in fencing.

The invention claimed is:

1. A method of securing an elongate member in the ground, including the steps of:

boring a hole of a selected diameter and to a selected depth in the earth:

inserting the elongate member into the hole, the elongate member having at least a lower most ground engaging portion with outer dimensions and shape that will nest with a closely matching diameter within the hole, the elongate member having a passageway passing fully therethrough from end to end and having an intersecting shape providing an intersection aperture:

inserting a ground anchor into the passageway of the elongate member, the ground anchor having:

a body with an elongate axis, a lower most ground engaging portion arranged to enter and be anchored in the ground by rotation thereof, an upper portion engageable by rotational driver means to effect a rotation of the ground anchor about the elongate axis thereof, a thread extending around at least a portion of said body, and a nut threadably engaging the thread;

effecting rotation of the ground anchor to an extent that the ground anchor intersects with earth beneath the hole and effects a holding of the elongate member in the ground thereby upon contact between the nut and the intersecting shape defining the intersection aperture; and tightening the nut by rotation thereof about the thread to effect a further pull down of the elongate member.

2. A method as in claim 1 further comprising the step of inserting a post into the elongate member to be supported thereby.

3. A method as in claim 1 characterized in that the elongate member is a post having a length longer than the depth of the hole.

4. A method as in claim 3 where there is the step of effecting entry of at least two ground anchors into the member each ground anchor aligned to pass through for each, a different opening at or toward the lower end of the member.

5. A method as in claim 1 further characterized in that the elongate member is of cylindrical outermost shape and has substantially the same diameter as the hole with which it is located.

6. An elongate member having:

a lower end shaped and of a size to be located and to be held within a hole in the ground;

a passageway through the member;

a ground anchor having:

a lower end with a ground engagable shape adapted to be screwed into the ground, an upper portion having a thread therearound, and a nut threadably engaging the thread, an intersecting shape within the elongate member, with a portion of the ground anchor being above such intersecting shape and the lower end of the ground anchor being below the intersecting shape, wherein a top of the ground anchor is shaped to receive and interlock with a rotatable driver and the nut engages the intersecting shape.

7. An elongate member as in claim 6 having a cylindrical outer diameter, and at or toward a lower end of the elongate member includes a portion which is the intersecting shape which is of lesser cross-sectional area.

8. An elongate member as in claim 7 having a cylindrical shape at least along a lower most portion, and having an outer diameter being of a constant size along at least the lower portion of the length of the elongate member.

* * * * *